313-414 SR
9/30/86 OR 4,614,894

United States Patent [19]
Izumida

[11] Patent Number: 4,614,894
[45] Date of Patent: Sep. 30, 1986

[54] ELECTRON GUN FOR COLOR PICTURE TUBE

[75] Inventor: Yukihiro Izumida, Mobara, Japan

[73] Assignee: Hitachi Ltd., Tokyo, Japan

[21] Appl. No.: 558,277

[22] Filed: Dec. 5, 1983

[30] Foreign Application Priority Data

| | | | |
|---|---|---|---|
| Dec. 6, 1982 | [JP] | Japan | 57-212787 |
| Dec. 15, 1982 | [JP] | Japan | 57-218380 |
| Dec. 17, 1982 | [JP] | Japan | 57-220080 |

[51] Int. Cl.[4] ..... H01J 29/50; H01J 29/56
[52] U.S. Cl. ..... 313/414; 313/449; 313/460
[58] Field of Search ..... 313/414, 449, 458, 460, 313/409, 412

[56] References Cited

U.S. PATENT DOCUMENTS

| | | | |
|---|---|---|---|
| 3,873,879 | 3/1975 | Hughes | 313/413 X |
| 3,984,723 | 10/1976 | Gross et al. | 313/412 |
| 4,288,718 | 9/1981 | Blacker et al. | 313/414 |
| 4,370,592 | 1/1983 | Hughes et al. | 313/414 |

FOREIGN PATENT DOCUMENTS

| | | | |
|---|---|---|---|
| 56-82548 | 7/1981 | Japan | 313/413 |
| 58-68848 | 4/1983 | Japan | 313/414 |

*Primary Examiner*—David K. Moore
*Assistant Examiner*—K. Wieder
*Attorney, Agent, or Firm*—Antonelli, Terry & Wands

[57] ABSTRACT

An electron gun of in-line type for color picture tube including a pair of electrodes for an electrostatic focusing lens is disclosed. Each of the pair of electrodes has three electron beam passing holes arranged in line. Each of the electron beam passing holes is so shaped that the maximum dimension in the direction in which the electron beam passing holes are arranged in line is smaller than that in the direction perpendicular to the first-mentioned direction, and that the maximum dimension in the latter direction is larger than the center-to-center spacing between the electron beam passing holes. At least part of the electrode surfaces including the opening edges of the three electron beam passing holes is a curved surface, so that the distance between the surfaces of the pair of opposite electrodes is made different in value along each opening edge.

22 Claims, 26 Drawing Figures

ELECTRON GUN FOR COLOR PICTURE TUBE

This invention relates to electron guns for color picture tube, and more particularly to an in-line type electron gun for color picture tube in which the focusing characteristic is improved.

The prior art and the present invention and the advantages of the latter will be described in detail with reference to the accompanying drawings, in which.

In general, the diameter of the main electrostatic focusing lens of the electron gun for color picture tube affects its focusing characteristic to a great extent, and thus, in order to obtain a proper focusing characteristic, it is desirable to maximize the diameter of the main focusing lens.

Figure 1:
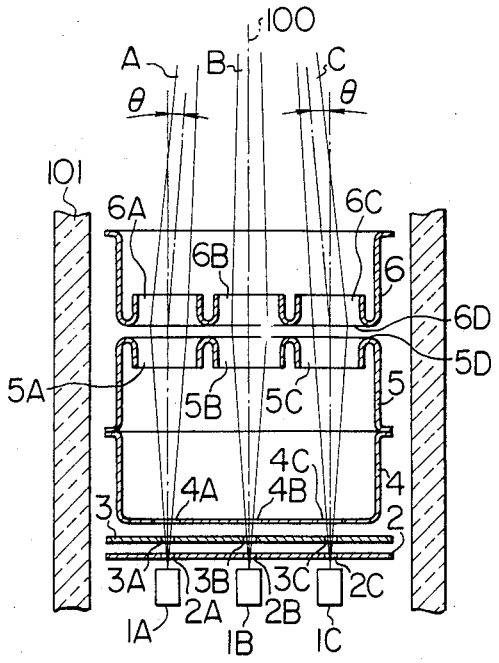
FIG. 1 is a cross-sectional diagram of a main part of the neck of a color picture tube, showing the structure of an in-line type electron gun.

FIG. 1 is a cross-sectional view of a main part of one example of an in-line type electron gun of bipotential focusing system. Referring to FIG. 1, there are shown cathodes 1A, 1B and 1C for emitting three electron beams from their top faces, a control electrode 2 for controlling the amounts of the electron beams, an accelerating electrode 3 for accelerating the electron beams, a lower focusing electrode 4 for focusing the electron beams, and electron beam passing holes 2A, 2B, 2C, 3A, 3B, 3C, 4A, 4B and 4C for the three electron beams. In addition, there are shown an upper focusing electrode 5 having electron beam passing holes 5A, 5B and 5C, the opening edges of which are defined or exist in its surface 5D, and an anode 6 having electron beam passing holes 6A, 6B and 6C the opening edges of which are defined or exist in its surface 6D. These electron beam passing holes are formed to have cylindrical portions by drawing as illustrated. The upper focusing electrode 5 and the anode 6 are of substantially the same shape, so that the surfaces 5D and 6D are separated by a predetermined distance along the tube axis, to dispose the holes 5A, 5B and 5C in opposed relation to the holes 6A, 6B and 6C, respectively. Thus, when predetermined potentials are applied to the upper focusing electrodes 5 and the anode 6, respectively, three main electrostatic focusing lenses are formed for the three electron beams. In this case, for example, the upper focusing electrode 5 is kept at potential of 7 kV, and the anode at potential of 25 kV. The electron beam passing holes have their centers coincident with the center axes of the electron beams passing therethrough, respectively, when viewed along the tube axis 100. The electron gun of such structure is disposed within a neck portion 101 of a color picture tube.

The electron beams A, B and C, which are controlled in their amounts by the signal potentials applied to the cathodes 1A, 1B and 1C, are slightly focused by prefocus lenses formed between the opposed holes of the accelerating electrode 3 and lower focusing electrode 4. Then, the electron beams are focused by the main focusing lenses formed by the upper focusing electrode 5 and anode 6 so that an image is formed on a phosphor screen of the picture tube not shown. At the same time, the electron beams A and C are tilted by angle $\theta$ to the center beam side so that the three electron beams A, B and C are converged at a point, by a known measure such that the beam passing holes 6A and 6C of the anode 6 are made eccentric to the outside with respect to the beam passing holes 5A and 5C of the upper focusing electrode 5. The spots of the beams focused on the phosphor screen of picture tube, depending on the focusing characteristic, are required to be as small as possible for high sharpness of picture. In general, the diameter of the main focusing lens is increased to improve the focusing characteristic.

Figure 2:
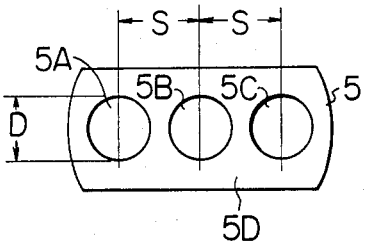
FIG. 2 PRIOR ART
FIG. 2 is a plan view of a conventional upper focusing electrode.

FIG. 2 is a plan view of the upper focusing electrode 5, showing the opposing surface 5D, which is of the same shape as the opposing surface 6D of the anode 6. Referring to FIG. 2, the beam passing holes 5A, 5B and 5C have diameter, D and arranged in line to be separated by a center-to-center spacing S. For example, in the case of the neck diameter of 22.5 mm, D=3.9 mm, and S=4.75 mm. In order to increase the diameters of the main focusing lenses for the improvement of the focusing characteristic, it is necessary to increase the diameter D of the beam passing holes 5A, 5B and 5C. However, to prevent the deterioration of the withstand voltage characteristic between the focusing electrode 5 and the anode 6 shown in FIG. 1, the beam passing holes 5A, 5B and 5C are necessary to be provided by drawing. Therefore, the diameter D of the holes made by drawing is restricted to be 0.8 to 1.0 mm smaller than the spacing S between the hole centers. The increase of the diameter D will require increase of the spacings. The increase of the spacing S will result in large convergence error at each point of the phosphor screen upon operation of picture tube and in increase of the dimension, orthogonal to the tube axis, of the upper focusing electrode 5 and anode 6 which form the main focusing lenses, so that they become close to the inner wall of the bulb neck within which the electron gun is placed, thus the withstand voltage characteristic being deteriorated.

Accordingly, it is an object of this invention to provide an electron gun for color picture tube in which the above-mentioned technical problems are reduced and the main electrostatic focusing lenses are increased in their diameter to have improved focusing characteristics.

According to the present invention, there is provided an electron gun for color picture tube with a tube axis comprising: three cathodes arranged in line in a first direction substantially perpendicular to the tube axis, the cathodes emitting three electron beams; a first electrode having three first electron beam passing holes arranged in line in the first direction so as to allow the corresponding electron beams to pass therethrough, and a surface having opening edges of the first electron beam passing holes, each of the first electron beam passing holes having its center coinciding with the center axis of the corresponding electron beam when viewed along the tube axis; and a second electrode disposed to oppose the first electrode and having three second electron beam passing holes arranged to oppose the first electron beam passing holes, respectively, and to allow the corresponding electron beams to pass therethrough, and a surface having opening edges of the electron beam passing holes, each of the second electron beam passing holes having its center coinciding with the center axis of the corresponding electron beam when viewed along the tube axis, the surface of the second electrode being opposed to the surface of the first electrode with a predetermined distance kept therebetween along the tube axis, the second electrode cooperating with the first electrode so as to form main electrostatic focusing lenses for the electron beams when the first and second electrodes are supplied with predetermined potentials, respectively; wherein each of the electron beam passing holes has a shape in which the maximum dimension in a second direction perpendicular to the first direction is larger than the maximum dimension in the first direction and larger than the center-to-center spacing between the electron beam passing holes arranged in line, at least part of the surface of each of the first and second electrodes is formed of a curved surface, at least part of the opening edge of each of the electron beam passing holes is defined in the curved surface, and the distance along the tube axis between the surfaces of the first and second electrodes disposed to oppose, is made larger at least at one of the edge portions of the opening edge determining the maximum dimension in the first direction than that at the edge portions of the opening edge determining the maximum dimension in the second direction.

Although the idea that the main electrostatic focusing lens is increased in its diameter to have improved focusing characteristic is disclosed in, for example, U.S. Pat. No. 4,370,592, the way to improve the focusing characteristic is that the diameter of the focusing lens is increased by increasing the spacing between the two opposed focusing electrodes. Thus, this Patent does not suggest the subject matter of the invention as will be understood from the following description.

Embodiments of this invention will hereinafter be described with reference to FIGS. 3 to 26, in which like parts corresponding to those of FIGS. 1 and 2 are identified by the same reference numerals or symbols.

Figure 3:
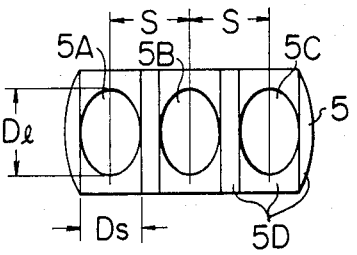
FIG. 3 is a plan view of an upper focusing electrode according to one embodiment of this invention.
Figure 4:
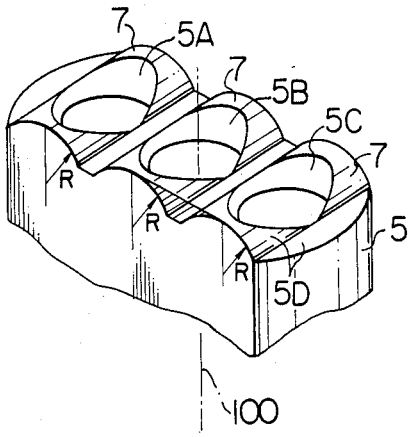
FIG. 4 is a perspective view of the upper focusing electrode in FIG. 3.

FIG. 3 is a plan view of an upper focusing electrode of an electron gun for color picture tube according to an embodiment of this invention. Referring to FIG. 3, there are shown the upper focusing electrode 5 having three elliptical beam passing holes 5A, 5B and 5C, each having major axis $D_l$ and minor axis $D_s$, arranged in line with the center-to-center spacing S in the direction in which the cathodes 1A, 1B and 1C are arranged (hereinafter, referred to as the first direction). Thus, each of the elliptical beam passing holes has the minor axis in the first direction, and major axis in the direction (hereinafter referred to as the second direction) perpendicular to the tube axis 100 and the first direction. Therefore, the major axis $D_l$ can be increased to be larger than the center-to-center spacing S without the restriction on the working of parts. Due to the elliptical shape of the beam passing holes 5A, 5B and 5C, the electron beams are more strongly focused in the minor-axis direction than in the major-axis direction to cause astigmatism, which can be corrected for by making parts of the surface 5D of the electrode 5 be curved surfaces 7 of radius R as shown in FIG. 4. This correction will be described later with reference to FIGS. 6A and 6B. This convex curved surface 7 has a convex curved line of part of a circle of curvature R of which the center is included in a plane including the center axis of the electron beam and extending in the second direction, in a plane parallel with the tube axis and extending in the first direction, and this curved surface covers a region with a width corresponding to the length of the minor axis of the elliptical beam passing hole. This convex curved surface 7 is not limited to the shape mentioned above, but may be a convex surface approximate thereto. In FIG. 4, the shaded area is only for the convenience of clearly showing the shape of the surface 5D. The anode 6 disposed to oppose the upper focusing electrode 5 of FIG. 4 has also substantially the same structure as the upper focusing electrode 5. Specifically, in the case of the neck diameter of 22.5 mm, $D_l=5$ mm, $D_s=3.9$ mm, $S=4.75$ mm, and when the difference between the maximum and minimum heights of the curved surface 7 along the tube axis is 1 mm, R is about 2.4 mm.

Figure 5:
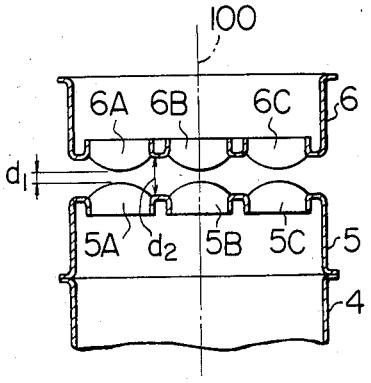
FIG. 5 is a cross-sectional view of a main part of the electron gun in which the upper focusing electrode of FIG. 3 is disposed to oppose an anode having a similar structure to the upper focussing electrode.

FIG. 5 is a cross-sectional view of a main part of the electron gun including the upper focusing electrode 5 shown in FIG. 4 and anode 6 of the same structure which are disposed to oppose each other. As shown in FIG. 5, as to the distance between the opposed surfaces of the focusing electrode 5 and anode 6 along the tube axis, the distance, $d_1$ at or around the ends of major axis of the opposed elliptical holes is smaller than the distance, $d_2$ at or around the ends of minor axis thereof. For example, $d_1=1$ mm, and $d_2=3$ mm.

Figure 6A:
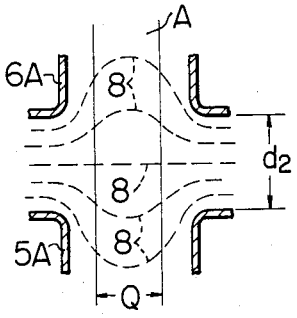
FIGS. 6A and 6B are cross-sectional views of a main part of the electron gun of FIG. 5, showing a main electrostatic focusing lens forming field produced by the upper focusing electrode and anode.
Figure 6B:
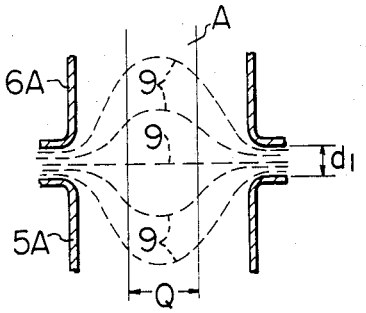
Figure 7:
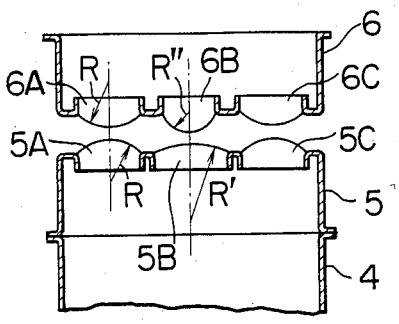
FIG. 7 is a cross-sectional view of a main part of a modification of the embodiment in FIG. 3, for the convergence of three electron beams.

FIGS. 6A and 6B show the distributions of potential for the main focusing lens formed by these beam passing holes of the upper focusing electrode 5 and anode 6 which are respectively applied with predetermined potentials. FIG. 6A is a cross-sectional view of a pair of beam passing holes 5A and 6A taken along a plane including minor axis and parallel with the tube axis, and FIG. 6B is a cross-sectional view of the holes 5A and 6A taken along a plane including the major axis and parallel with the tube axis. As illustrated, by taking the distance $d_2$ larger than $d_1$ the equipotential planes, 8 in FIG. 6A can be distributed within the electron beam passing region, Q in the beam passing hole approximately as the equipotential planes, 9 in FIG. 6B. Thus, within the electron beam passing region Q, a rotationally symmetrical field is established, correcting for the astigmatism. Also, since the potential distribution of FIG. 6A is approximate to that of FIG. 6B, the diameter of the main focusing lens can be increased to be substantially equal to that of a circular beam passing hole having the same diameter as the major axis $d_l$ of the elliptical beam passing hole. Therefore, the electron gun can be improved in its focusing characteristic with the above-mentioned problems reduced.

The electron beams on both sides of the center beam can be converged by the following way. As shown by a cross-sectional view of a main part in FIG. 7, the elliptical ratio $D_s/D_l$ of the center beam passing hole 5B of the upper focusing electrode 5 is made larger than that of the side beam passing holes 5A and 5C so that the curvature, R′ of the convex curved surface is increased, whereby the top face of the convex curved surface including the opening edge of the center hole 5B of the upper focusing electrode 5 is made lower than those of the convex curved surfaces including the opening edges of the side holes 5A and 5C. Moreover, the elliptical ratio of the center beam-passing hole 6B of the anode 6 is made smaller than that of the side beam passing holes 6A and 6C so that the curvature R″ of the convex curved surface is reduced and that the top face of the convex curved surface including the opening edge of the center hole 6B of the anode 6 is made higher than those of the convex curved surfaces including the opening edges of the side holes 6A and 6C. By taking such structure for the focusing electrode 5 or anode 6 or both, it is possible to establish an inclined field in the main focusing lenses for the side electron beams, formed by the beam passing holes 5A and 6A and 5C and 6C so that the side beams can be converged. The values of curvatures R′ and R″ are determined experimentally. For convergence, as in the prior art, it is also possible to displace by a small amount the side beam passing holes 6A and 6C of the anode 6 to the outside with respect to the side beam passing holes 5A and 5C of the upper focusing electrode 5.

Figure 8:
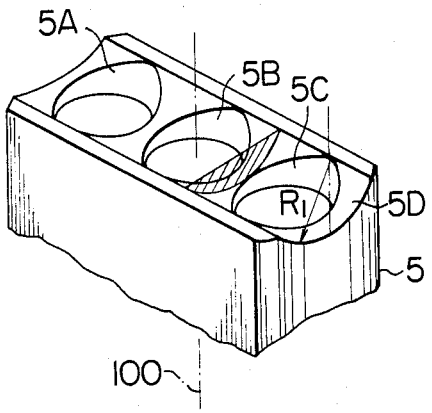
FIG. 8 is a perspective view of an upper focusing electrode according to another embodiment of this invention.

FIG. 8 is a perspective view of the upper focusing electrode of an electron gun for color picture tube according to another embodiment of this invention. The upper focusing electrode 5 in FIG. 8 has elliptical beam passing holes 5A, 5B and 5C spaced as in FIG. 3, but at least part of the surface 5D is a concave curved surface for correcting the astigmatism due to the elliptical beam passing holes. This concave curved surface has a concave curved line of a predetermined curvature $R_1$ the center of which is in a plane including the center axes of three electron beams, in a plane parallel with the tube axis 100 and extending in the second direction. The curved surface covers at least the region of the width corresponding to the length of the major axis of the elliptical hole. The shaded area in FIG. 8 is only for the convenience of clearly showing the shape of the concave curved surface. The curvature $R_1$ is experimentally determined, the depth of the concave curved surface being about 1 mm, for example.

The anode 6 disposed to oppose the upper focusing electrode 5 in FIG. 8 is of the same structure as the electrode 5. Thus, the distance between the opposed surfaces of the focusing electrode 5 and anode 6 along the tube axis is as in the embodiment of FIG. 4. That is, it will easily be understood that the distance at or around the ends of the major axis of the elliptical beam passing holes is smaller than that at or around the ends of the minor axis thereof.

Figure 9:
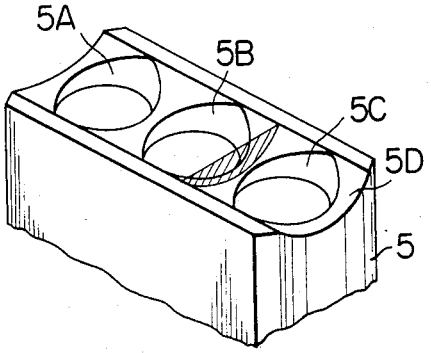
FIG. 9 is a perspective view of an upper focusing electrode according to another embodiment of this invention.

FIG. 9 is a perspective view of the upper focusing electrode 5 of an electron gun according to still another embodiment of this invention. In this embodiment, the concave curved surface formed in the surface 5D of the focusing electrode 5 is an elliptical curved surface and the other portions are the same as in FIG. 8. This concave curved surface has a semi-elliptical curve or part thereof resulting from halving, relative to the major axis, the elliptical curve having its center in a plane including the center axes of three electron beams and having its major axis in the second direction and its minor axis along the tube axis, in a plane parallel with the tube axis and extending in the second direction. Experiment revealed that for correcting the astigmatism the elliptical concave curved surface in FIG. 9 is more effective than the concave curved surface with the curvature $R_1$ in FIG. 8. It is also possible to form the surface 5D to be concave curved surface approximate to that of FIG. 8 or 9.

Figure 10:
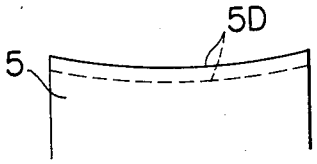
FIG. 10 is a side view of an upper focusing electrode showing a modification of the embodiment of FIGS. 8 and 9, for the convergence of three electron beams.
Figure 11:
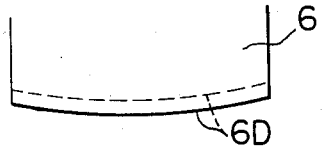
FIG. 11 is a side view of an anode disposed to oppose the upper focusing electrode in FIG. 10.

In the embodiments of FIGS. 8 and 9, the convergence of the side beams can be achieved as follows. As shown in FIGS. 10 and 11, in the electrode 5, at least a region of the surface 5D in which a concave curved surface is formed is curved down in its center to the cathode side, and/or in the anode 6 at least a region of the surface 6D in which a concave curved surface is formed is curved to project in its center to the cathode side. That is, at least one of the surfaces 5D and 6D of the upper focusing electrode 5 and anode 6, at least in a region in which a concave curved surface is formed, is curved to have a curve line with its center being closer to the cathodes than both ends, in a plane parallel with the tube axis and extending in the first direction. The curvature of this curved surface is experimentally determined.

Figure 12:
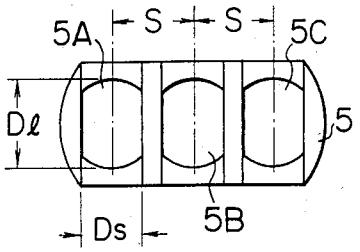
FIG. 12 is a plan view of an upper focusing electrode according to still another embodiment of this invention.

FIG. 12 is a plan view of the upper focusing electrode of an electron gun according to a further embodiment of this invention. Although the previously described embodiments employ elliptical beam passing holes as shown in FIG. 3, in this embodiment the beam passing holes 5A, 5B and 5C are of circular shape of diameter $D_l$ with both side portions cut away to have a width $D_s$ which has a center line coincident with the diameter extending in the second direction as illustrated. Also, in this invention, substantially the same effect as above can be achieved.

Figure 13:
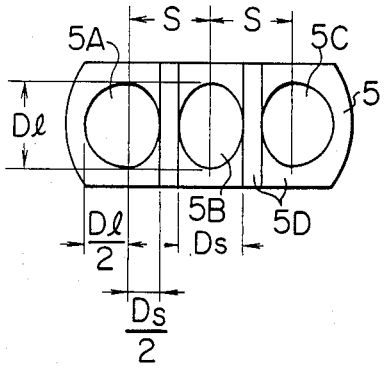
FIG. 13 is a plan view of the upper focusing electrode according to the still another embodiment of this invention.

FIG. 13 is a plan view of the upper focusing electrode of an electron gun according to a still further embodiment of this invention. In the upper focusing electrode 5 in this embodiment, the center beam passing hole 5B is of an elliptical shape with minor axis $D_s$ in the first direction and major axis $D_l$ in the second direction, and has a center coincident with the center axis of the electron beam when it is viewed in the direction of the tube axis. Each of the side beam passing holes 5A and 5C is, on the inside, or on the center beam passing hole side of the center axis of the electron beam, of semi-elliptical shape like a half of the ellipse of the center beam passing hole 5B with respect to the major axis, and on the outside, or the opposite side of the center axis of the electron beam to the center passing hole side, of semi-circular shape of radius $D_l/2$; i.e., each of the side beam passing holes 5A and 5C is of a composite shape of the semi-ellipse and the semi-circle. These beam passing holes 5A, 5B and 5C are arranged in line to have a center-to-center spacing S in the first direction. Also in this embodiment, the major axis $D_l$ can be increased to be larger than the spacing S between the holes without the restriction on working of parts. In addition, since the length of the upper focusing electrode 5 in the horizontal direction (i.e. the first direction) is smaller than that of the focusing electrode in which three circular beam passing holes of diameter $D_l$ are provided, it is possible to reduce deterioration of the withstand voltage characteristic which is caused when the electrode 5 is close to the inner wall of the bulb neck.

Figure 14:
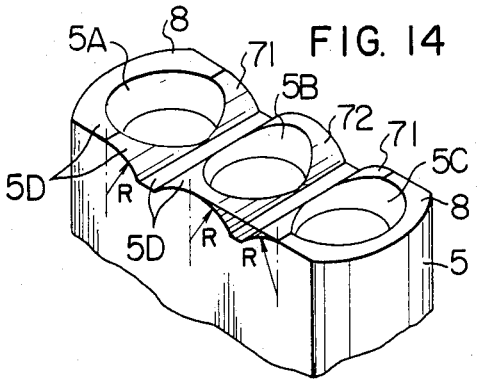
FIG. 14 is a perspective view of the upper focusing electrode of FIG. 13.

FIG. 14 is a perspective view of the upper focusing electrode 5 shown in FIG. 13. Since astigmatism is caused under the elliptical and composite shapes of the beam passing holes 5A, 5B and 5C as described previously, part of the surface 5D is made to be convex curved surfaces 71 and 72 as shown in FIG. 14. A convex curved surface 72 is formed over the region of the width corresponding to the length of the minor axis of the ellipse shape of the center beam passing hole, and another convex curved surface 71 is formed over the region of the width corresponding to the length of the half minor axis of the semi-ellipse shape of each side beam passing hole. Since no astigmatism is caused in the semi-circle portions of the side beam passing holes, the region 8 of each side beam passing hole on the outside of the center axis of beam is not necessary to be a curved surface. This region 8 on the outside is formed of a plane substantially flush with, or aligned with the top face of the convex curved surface. In other words, the surface 5D, in a plane parallel with the tube axis and extending in the first direction, has a convex curved line of curvature R of which the center lies in a plane including the center axis of each beam, in the regions of the width corresponding to the length of the minor axis and of the width corresponding to the length of each semi-minor axis, and a straight line substantially flush with the top of the convex curved line, in the region on the outside of the center axis of the electron beam of each side beam passing hole. In FIG. 14, the shades area is only for the convenience of clearly showing the shape of the surface 5D.

Figure 15:
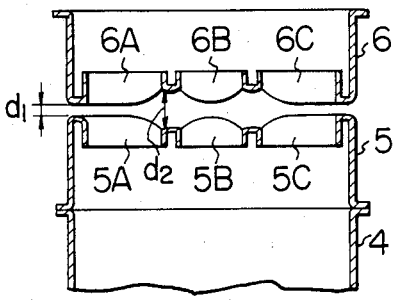
FIG. 15 is a cross-sectional view of a main part of the electron gun including the upper focusing electrode of FIG. 14 and an anode having a similar structure to the upper focusing electrode, opposed to each other.

The anode 6 disposed to oppose the upper focusing electrode 5 of FIG. 14 is of substantially the same structure as the upper focusing electrode. FIG. 15 is a cross-sectional view of a main part of the electron gun according to this embodiment, similar to FIG. 5. In this embodiment, the distance between the opposed surfaces of the upper focusing electrode 5 and anode 6 along the tube axis is the same as in FIG. 5 except the outside portions of both side beam passing holes. Therefore, it is possible to correct astigmatism and increase the diameter of the main focusing lens.

In this embodiment, the distance between the opposed surfaces along the periphery of the semi-circle on the outside of each side beam passing hole is $d_1$. This structure is suitable for preventing side electron beams from being affected by an increase in potential on the inner surface of the bulb neck causing a convergence drift with time. The convex surfaces 71 and 72 are not limited to the shapes shown above, but may be approximate thereto.

Figure 16:
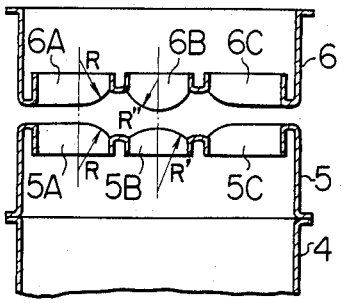
FIG. 16 is a cross-sectional view of a main part of the electron gun showing a modification of the embodiment of FIG. 14 for the convergence of three electron beams.

FIG. 16 shows the way to converge the side electron beams in the embodiment of FIGS. 13, 14 and 15. This way is the same as described with reference to FIG. 7.

Figure 17:
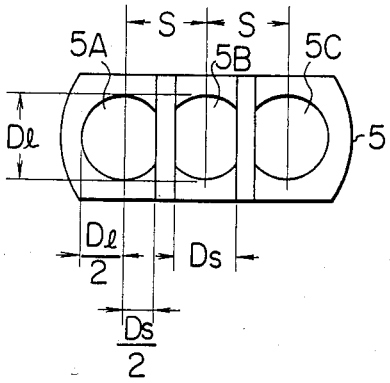
FIG. 17 is a plan view of an upper focusing electrode according to further embodiment of the invention.

FIG. 17 is a plan view of the upper focusing electrode of an electron gun according to still further embodiment of this invention. Instead of the elliptical shape of the center beam passing hole 5B in the embodiment of FIGS. 13, 14 and 15, there is provided a partially cut away circle of diameter $D_l$, which has a width $D_s$ with the same partial widths on both sides of the diameter extending in the second direction. In addition, instead of the composite shape of the semi-circle and the semi-ellipse of each of the side beam passing holes 5A and 5C, there is provided a composite shape of a semi-circle of diameter $D_l$ and a half of the partially cut away circle of the center beam passing hole. In this embodiment, it is possible to achieve the same effect as in FIGS. 13, 14 and 15.

Figure 18:
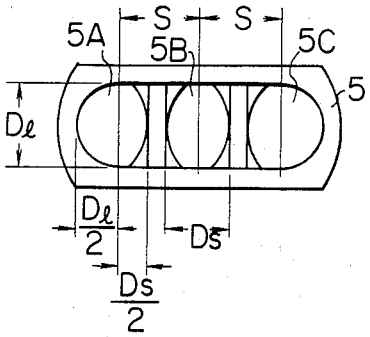
FIG. 18 is a plan view of the upper focusing electrode according to further embodiment of this invention.
Figure 19:
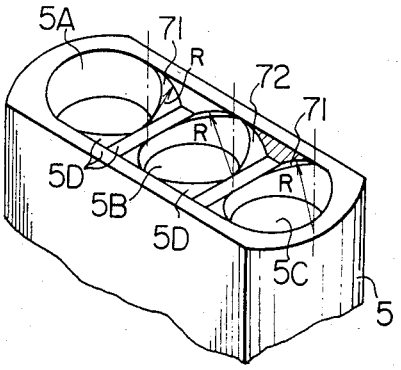
FIG. 19 is a perspective view of the upper focusing electrode of FIG. 18.

FIG. 18 is a plan view of the upper focusing electrode of an electron gun according to further embodiment of this invention. FIG. 19 is a perspective view thereof. The shape of the beam passing holes 5A, 5B and 5C and the center-to-center spacing between the holes in this embodiment are the same as in the embodiment of FIGS. 13, 14 and 15, and in this embodiment part of the surface 5D is similarly formed to be a convex curved surface in order to compensate for the astigmatism. This embodiment is different from the embodiment of FIGS. 13, 14 and 15 in that as shown in FIG. 19, a convex curved surface as shown in FIG. 14 is formed only in the region of the surface 5D surrounded by the outer semi-circles of the side beam passing holes and the tangents to these semi-circles, and that the outside of the region, or the peripheral portion, is formed to be a plane aligned with the top face of the convex curved surface. In other words, the upper focusing electrode 5 has side walls of the same height as that of the top of the convex curved surface on the outside of the above-mentioned region. Therefore, the convex curved surface is formed, in the second direction, over the range of the width corresponding to the length of the major axis of the elliptical shape of the electron beam passing holes. That is, this surface 5D is shaped to have side walls on the periphery and convex curved surfaces 71 and 72 of the same height as that of the side walls in the recessed portion.

Figure 20:
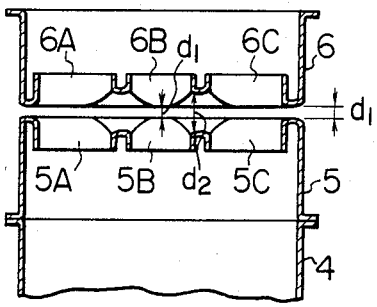
FIG. 20 is a cross-sectional view of the electron gun including the upper focusing electrode of FIG. 19 and an anode opposed to each other having a similar structure to the upper focusing electrode.

The anode 6 disposed to oppose the upper focusing electrode 5 of FIG. 19 is formed to have substantially the same shape as the electrode 5. FIG. 20 is a cross-sectional diagram of a main part of the electron gun according to this embodiment, similar to FIG. 5. In this embodiment, the distance between the opposed surfaces of the upper focusing electrode 5 and anode 6 along the tube axis is given as in FIG. 5 except the periphery of the opposed surfaces. Thus, it is possible to correct for the astigmatism and increase the main focusing lens diameter.

In this embodiment, the distance between the opposed surfaces is minimized to be $d_1$ over all the peripheries of the electrodes 5 and 6. Thus, this structure is more suitable for reducing the convergence drift mentioned above.

Figure 21:
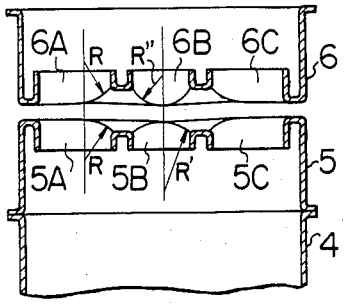
FIG. 21 is a cross-sectional view of a main part of the electron gun showing a modification of the embodiment of FIG. 19 for the convergence of three electron beams.

FIG. 21 shows the way to converge the side beams in the embodiment of FIGS. 18, 19 and 20. This way is the same as described with reference to FIG. 7.

In the embodiment of FIGS. 18, 19, 20 and 21, $D_l=5.0$ mm, $D_s=3.9$ mm, $S=4.75$ mm, $d_1=1$ mm and $d_2=3$ mm, as an example. The curvatures R, R′ and R″ are experimentally determined. The shape of convex curved surface is not limited to the above-given ones, but may be approximate thereto.

Figure 22:
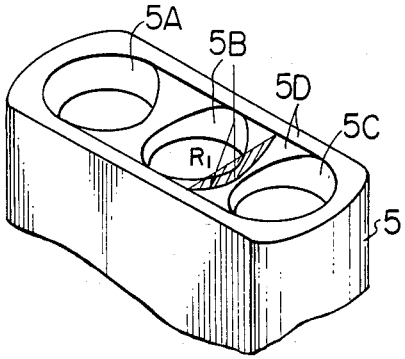
FIG. 22 is a perspective view of an upper focusing electrode according to still further embodiment of this invention.

FIG. 22 is a perspective view of the upper focusing electrode of an electron gun according to further embodiment of this invention. Also in this embodiment, the beam passing holes 5A, 5B and 5C have the shape shown in FIG. 18 and are arranged with the center-to-center spacing S of FIG. 18. In this embodiment, the surface 5D is shaped to have a concave surface similar to that shown in FIG. 8 in the region except the periphery of the surface 5D of the focusing electrode, or only in the region surrounded by the semi-circles of the side beam passing holes 5A and 5C and the tangents to these semi-circles and between the center axes of the side electron beams. The beam passing holes outside of the center axes of the side electron beams are of semi-circular shape, and therefore a concave curved surface is not necessary to be formed on this side portion. The concave curved surface to be formed, in a plane parallel with the tube axis and extending in the second direction, has a concave curve line of a predetermined curvature $R_1$ with its center lying in a plane including the center axes of the three electron beams. In FIG. 22, the shaded area is only for convenience of clearly showing the concave curved surface. The curvature $R_1$ is experimentally determined and the depth of the concave curved surface is about 1 mm as an example. In this embodiment, a side wall corresponding to the depth of the concave curved surface is formed on the outside of the region, i.e., in the periphery of the surface 5D.

The anode 6 disposed to oppose the upper focusing electrode 5 of FIG. 22 is of substantially the same structure. Thus, when the upper focusing electrode 5 and anode 6 are disposed to oppose each other, the distance between the opposed surfaces 5D and 6D thereof along the tube axis is as follows. The distance $d_1$ at the ends and their vicinities of the major axis of the ellipse which forms the beam passing hole or its part (in other words, at the opening edge portions determining the maximum dimension of the beam passing hole in the second direction), is smaller than the distance $d_2$ at the ends and their vicinities of the minor axis or at the end and its vicinity of semi-minor axis of the ellipse (in other words, at at least one of the opening edge portions determining the maximum dimension of the beam passing hole in the first direction), and the minimum distance $d_1$ is kept at the periphery of the opposed surfaces. As a result, it is possible to achieve the same effect as in the embodiment of FIGS. 18, 19 and 20.

Figure 23:
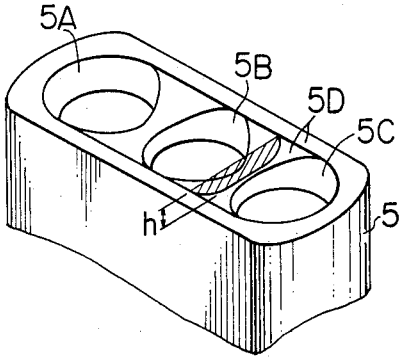
FIG. 23 is a perspective view of an upper focusing electrode according to still further embodiment of this invention.

FIG. 23 is a perspective view of the upper focusing electrode of an electron gun according to further embodiment of this invention. In this embodiment, the concave curved surface formed in the surface 5D of the upper focusing electrode 5 has an elliptical curved surface and others are the same as in the embodiment of FIG. 22. This concave curved surface, in a plane parallel with the tube axis and extending in the second direction, has a semi-ellipitcal curve resulting from halving, with respect to the major axis, an elliptical curve having its center in a plane including the center axes of three electron beams, the major axis in the second direction and the minor axis along the tube axis, or has part of that semi-elliptical curve. Experiment revealed that to correct for the astigmatism the elliptical concave curved surface shown in FIG. 23 is more effective than the concave curved surface of curvature $R_1$ shown in FIG. 22. The depth h of the concave curved surface is determined by the major axis $D_l$ and elliptical ratio $D_s/D_l$ of the ellipse which is the shape of the beam passing holes or part thereof, and the elliptical curve in the cross-section of this concave curved surface can be determined by values of $D_l$ and h. For example, when $D_l=5.0$ mm, and $h=1.0$ mm, the concave curved surface has in its cross-section a half of the ellipse curve expressed by $(y/2.5)^2+(z/1)^2=1$, where y-axis is in the second direction, and z-axis is in the tube-axis direction. In FIGS. 22 and 23, the shaded area is only for convenience of clearly showing the shape of the concave curved surface. The shape of the concave curved surface of FIGS. 22 and 23 is not limited to the above, but may be approximate thereto.

Figure 24:
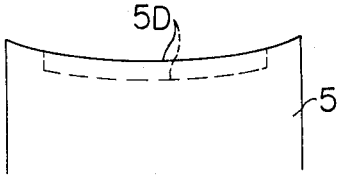
FIG. 24 is a side view of the upper focusing electrode showing a modification of the embodiment of FIGS. 22 and 23 for the convergence of three electron beams.
Figure 25:
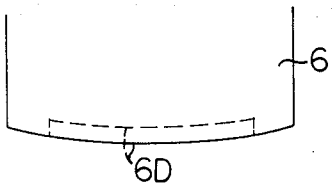
FIG. 25 is a side view of the anode disposed to oppose the upper focusing electrode of FIG. 24.

In the embodiment of FIGS. 22 and 23, the convergence of the side beams can be achieved as follows. As shown in FIGS. 24 and 25, in the upper focusing electrode 5, at least the region of the surface 5D in which a concave curved surface is formed, is curved down in its center on the cathode side, and/or in the anode 6, at least the region of the surface 6D in which a concave curved surface is formed, is curved up in its center on the cathode side.

In other words, at least in one of the surfaces 5D and 6D of the upper focusing electrode 5 and anode 6, at least the region in which the concave curved surface is formed has, in a plane parallel with the tube axis and extending in the first direction, a curve of which the center is closer to the cathode than the ends thereof. The curvature of this concave curved surface is experimentally determined.

Figure 26:
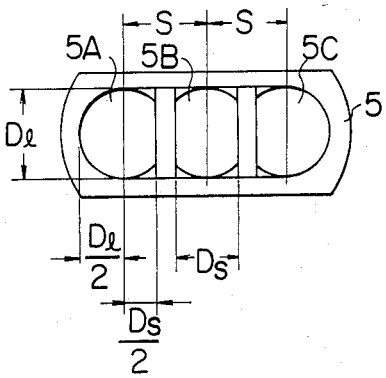
FIG. 26 is a plan view of an upper focusing electrode according to a still further embodiment of this invention.

FIG. 26 is a plan view of the upper focusing electrode of the electron gun according to further embodiment of this invention. The electron beam passing holes in the embodiment of FIGS. 18 and 19 are changed in their shapes to the shapes in FIG. 17. In this case, it is possible to achieve the same effect as in the embodiment of FIGS. 18 and 19. It is of course possible to similarly change the shapes of the beam passing holes in the embodiment of FIGS. 22 and 23, with the same effect.

In the previously mentioned embodiments, the beam passing holes are not necessary to have the same shape and size in both the upper focusing electrode and the anode, or even in the same electrode, and the curvatures R and $R_1$ may be any value for correcting the astigmatism even in the same electrode. Also, the curvatures R and $R_1$ may be either a connection of a plurality of curvatures, or an approximated straight line. Moreover, the end of the cylindrical portion of the beam passing hole formed by drawing may be of any shape.

Furthermore, while the bipotential focus type electron gun has been described in the above embodiments, application of the invention is not limited thereto, but may of course be applied to the main electrostatic focusing lens forming electrodes of other unipotential-type or multifocus type electron guns with the same effect as above.

I claim:

1. An electron gun for color picture tube with a tube axis comprising:

three cathodes arranged in line in a first direction substantially perpendicular to said tube axis said cathodes emitting three electron beams;

a first electrode having three first electron beam passing holes arranged in line in said first direction so as to allow the corresponding electron beams to pass therethrough, and a surface having opening edges of said first electron beam passing holes, each of said first electron beam passing holes having its center coinciding with the center axis of the corresponding electron beam when viewed along said tube axis; and a second electrode disposed to oppose said first electrode and having three second electron beam passing holes arranged to oppose said first electron beam passing holes, respectively, and to allow the corresponding electron beams to pass therethrough, and a surface having opening edges of said second electron beam passing holes, each of said second electron beam passing holes having its center coinciding with the center axis of the corresponding electron beam when viewed along said tube axis, said surface of said second electrode being opposed to said surface of said first electrode with a predetermined distance kept therebetween along said tube axis, said second electrode cooperating with said first electrode so as to form main electrostatic focusing lenses for said electron beams when said first and second electrodes are supplied with predetermined potentials, respectively;

wherein each of said electron beam passing holes has a shape in which the maximum dimension in a second direction perpendicular to said first direction is larger than the maximum dimension in said first direction and larger than the center-to-center spacing between said electron beam passing holes arranged in line, a substantial part of said surface of each of said first and second electrodes is formed of a curved surface, at least part of said opening edge of each of said electron beam passing holes is defined in said curved surface, and said distance along said tube axis, between said surfaces of said first and second electrodes disposed to oppose, is made larger at least at one of the edge portions of said opening edge determining the maximum dimension in said first direction than that at the edge portions of said opening edge determining the maximum dimension in said second direction.

2. An electron gun according to claim 1, wherein when viewed along said tube axis each of said electron beam passing holes has a minor axis in said first direction, a major axis in said second direction, and an elliptical shape with its center coinciding with the center axis of the corresponding electron beam.

3. An electron gun according to claim 2, wherein said surface of each of said first and second ellectodes has, in a plane parallel with said tube axis and extending in said first direction, a convex curve of a predetermined curvature with its center lying in a plane including the center axis of one of said electron beams and extending in said second direction, or a convex curved surface having a curve approximate thereto in regions of the width corresponding to the length of said minor axes.

4. An electron gun according to claim 3, wherein in each of said first and second electrodes the elliptical ratio of the center electron beam passing hole is made different from that of side electron beam passing holes, and the curvature of the curved surface of a region with a width corresponding to the length of the minor axis of the center electron beam passing hole is made different from that of the side electron beam passing holes.

5. An electron gun according to claim 3, wherein said side electron beam passing holes of said second electrode are displaced slightly relative to those of said first electrode.

6. An electron gun according to claim 2, wherein said surface of each of said first and second electrodes has, in a plane parallel with said tube axis and extending in said second direction, one of a concave curve of a predetermined curvature with its center lying in a plane including the center axes of said electron beams, and a concave curved surface having a curve approximate thereto in a region with a width corresponding to the length of said major axis.

7. An electron gun according to claim 6, wherein said surface of at least one of said first and second electrodes has, in a plane parallel with said tube axis and extending in said first direction, a curve the center of which is closer to said cathodes than the ends thereof, at least in a region of a width corresponding to the length of said major axis.

8. An electron gun according to claim 2, wherein said surface of each of said first and second electrodes has, in a plane parallel with said tube axis and extending in said second direction, one of a concave curve of part of an elliptical curve with its center lying in a plane including the center axes of said electron beams, and a concave curved surface having a curve approximate thereto, in a region of a width corresponding to the length of said major axis.

9. An electron gun according to claim 8, wherein said surface of at least one of said first and second electrodes has, in a plane parallel with said tube axis and extending in said first direction, a curve of which the center is closer to said cathodes than the ends thereof.

10. An electron gun according to claim 1, wherein when viewed along said tube axis, said center electron beam passing hole is of an elliptical shape having its center coinciding with the center axis of the electron beam, its minor axis in said first direction, and its major axis in said second direction, each of said side electron beam passing holes is of a composite shape consisting of on the center electron passing hole side of the center axis of electron beam, a semi-elliptical shape having its semi-minor axis equal to half of said minor axis in said first direction and its major axis equal to said major axis in said second direction, and on the opposite side of the center axis of electron beam to the center electron beam passing hole, a semi-circular shape having its center coinciding with the center axis of electron beam, and its diameter equal to said major axis.

11. An electron gun according to claim 10, wherein said surface of each of said first and second electrodes has, in a plane parallel with said tube axis and extending in said first direction, one of a convex curve of a predetermined curvature with its center lying in a plane including the center axis of electron beam and extending in said second direction, and a convex curve having a curve approximate thereto, in regions of the widths corresponding to the length of said minor axis and to that of said semi-minor axis.

12. An electron gun according to claim 11, wherein in each of said first and second electrodes, the elliptical ratio of the center electron beam passing hole is made different from that of the side electron beam passing holes, and the curvature of the curved surface in the region of the width corresponding to the length of said minor axis of the center electron beam passing hole is made different from that of the width corresponding to the length of said semi-minor axis of the side electron beam passing holes.

13. An electron gun according to claim 11, wherein the side electron beam passing holes of said second electrode are displaced slightly relative to those of said first electrode.

14. An electron gun according to claim 10, wherein said surface of each of said first and second electrodes, in a plane parallel with said tube axis and extending in said first direction, has only in the region defined by said semi-circles of said side electron beam passing holes and the tangents thereto, one of a convex curve of a predetermined curvature with its center lying in a plane including the center axis of electron beam and extending in said second direction and a convex curve having a curve approximate thereto, within the regions of the widths corresponding to the lengths of said minor axis and said semi-minor axes, and each of said electrodes has a side wall of the height substantially equal to that of the convex curve on the outside of said region.

15. An electron gun according to claim 14, wherein in each of said first and second electrodes, the elliptical ratio of the center electron beam passing hole is made different from that of the side electron beam passing holes, and the curvature of the curved surface of the region with the width corresponding to the length of said minor axis of said center electron beam passing hole is made different from that with the width corresponding to the length of said semi-minor axis of said side electron beam passing holes.

16. An electron gun according to claim 14, wherein said side electron beam passing holes of said second electrode are displaced slightly in said first direction relative to those of said first electrode.

17. An electron gun according to claim 10, wherein said surface of each of said first and second electrodes has, in a region defined by said semi-circle of said side electron beam passing holes and the tangents thereto, and between the centers of the side electron beam passing holes in said region, one of a concave curve of a predetermined curvature with its center lying in a plane including the center axis of electron beams and a concave surface having a curve approximate thereto, in a plane parallel with said tube axis and extending in said second direction, and each of said electrodes has side walls of a height equal to the depth of said concave surface in the outside of said region.

18. An electron gun according to claim 17, wherein said surface of at least one of said first and second electrodes, in a plane parallel with said tube axis and extending in said first direction, has at least in said region a curve of which the center is closer to said cathodes than the ends thereof.

19. An electron gun according to claim 10, wherein said surface of each of said first and second electrodes, in a plane parallel with said tube axis and extending in said second direction, has only between the center axes of said both-sides electron beam passing holes in a region defined by said semi-circle of said side electron beam passing holes and the tangents thereto one of a concave curve of part of an elliptical curve with its center lying in a plane including the center axes of electron beams and a concave surface having a curve approximate thereto and becoming depressed from said plane, and each of said electrodes has side wall of the height equal to the depth of said concave surface in the outside of said region.

20. An electron gun according to claim 19, wherein said surface of at least one of said first and second electrodes, in a plane parallel with said tube axis and extending in said first direction, has at least in said region a curve of which the center is closer to the cathodes than the ends thereof.

21. An electron gun according to claim 1, wherein, when viewed along said tube axis each of said electron beam passing holes has such a part of a circle with its center coinciding with the center axis of electron beam and with its diameter being a predetermined value that said circle is partially cut away on both sides of the diameter extending in said second direction so as to have opposite end edges of a certain length along said second direction.

22. An electron gun according to claim 1, wherein each of said center electron beam passing holes, when viewed along said tube axis, has such a part of a circle of which the center coincides with the center axis of electron beam and of which the diameter has a predetermined value, that said circle is partially cut away on both sides of the diameter extending in said second direction so as to have opposite end edges of a certain length along said second direction, and each of side electron beam passing holes has a compose shape consisting of, on the opposite side of the center axis of electron beam to the center electron beam passing hole, a half of said circle, and on the center electron beam passing hole side of said center axis such a part of said half of said circle that said half is partially cut away on said center electron passing hole side so as to have an end edge of a half of said certain length along said second direction.

* * * * *